US006047880A

United States Patent [19]

Petkovsek

[11] Patent Number: 6,047,880

[45] Date of Patent: Apr. 11, 2000

[54] SPECIAL SERVICE MAILPIECE HAVING AN INTEGRAL DOCUMENT SECTION AND A METHOD FOR FORMING SAME

[76] Inventor: Glenn Petkovsek, 20 Tortoise Park Cove, Little Rock, Ark. 72211-2349

[21] Appl. No.: 09/231,206

[22] Filed: Jan. 14, 1999

Related U.S. Application Data

[63] Continuation of application No. 08/747,228, Nov. 12, 1996, Pat. No. 5,860,904, which is a continuation of application No. 08/398,748, Mar. 6, 1995, abandoned.

[51] Int. Cl.[7] ..... B65D 27/00

[52] U.S. Cl. ..... 229/92.8; 229/68.1; 229/92.1; 229/300

[58] Field of Search ..... 229/92.8, 70, 92.1, 229/300, 68.1

[56] References Cited

U.S. PATENT DOCUMENTS

| | | | |
|---|---|---|---|
| 1,299,021 | 4/1919 | Planche | 229/92.1 |
| 1,436,885 | 11/1922 | Leary | 229/70 |
| 2,270,455 | 1/1942 | Lichter | 229/92.8 |
| 2,279,164 | 4/1942 | Gettleman | 229/92.8 |
| 2,805,816 | 9/1957 | Morgan . | |
| 2,840,295 | 6/1958 | Fromm | 229/70 |
| 3,937,492 | 2/1976 | Biron . | |
| 3,968,927 | 7/1976 | Katz et al. . | |
| 4,368,903 | 1/1983 | Jones . | |
| 4,809,905 | 3/1989 | Goodman . | |
| 4,983,438 | 1/1991 | Jameson . | |
| 5,039,652 | 8/1991 | Doll et al. . | |
| 5,071,167 | 12/1991 | O'Brien . | |
| 5,183,203 | 2/1993 | Sanders . | |
| 5,190,210 | 3/1993 | Walz . | |
| 5,267,898 | 12/1993 | Doll et al. . | |
| 5,316,208 | 5/1994 | Petkovsek . | |
| 5,325,303 | 6/1994 | Walz . | |
| 5,383,686 | 1/1995 | Laurash . | |
| 5,507,526 | 4/1996 | Petkovsek . | |
| 5,547,227 | 8/1996 | Laurash et al. . | |
| 5,860,904 | 1/1999 | Petkovsek | 229/92.8 |

*Primary Examiner*—Stephen P. Garbe
*Attorney, Agent, or Firm*—Patents & TMS, P.C.

[57] ABSTRACT

A special service mailpiece having an integral document section and a method for forming the mailpiece requiring special services are provided. The mailpiece has an integral document section requiring special service mailing and includes a sheet folded into a section along a fold line then sealed to close the integral document section. The sheet further has a removably attached section which, after the system is folded and sealed, forms a return postcard and at least one form. The return postcard and the form are integrally formed, but removably attached, such that the return postcard remains attached to the mailpiece until received by the addressee at which time it may be removed.

9 Claims, 5 Drawing Sheets

SPECIAL SERVICE MAILPIECE HAVING AN INTEGRAL DOCUMENT SECTION AND A METHOD FOR FORMING SAME

This application is a continuation of U.S. patent application Ser. No. 08/747,228 filed Nov. 12, 1996, now U.S. Pat. No. 5,860,904, which is a continuation of U.S. patent application Ser. No. 08/398,748 filed Mar. 6, 1995, now abandoned.

BACKGROUND OF THE INVENTION

The present invention generally relates to a combined form and envelope for mailing an article requiring special services. More specifically, the present invention relates to a combined special service mailpiece having an integral document section requiring special services wherein a detachable form and return postcard are also attached to the mailpiece prior to assembly thereof.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service requires an article to be mailed by certified mail, for example, an envelope containing the article is provided to the postal employee by the customer. The postal employee is then required to attach or otherwise provide the envelope with a permanent seal or label indicating that the envelope requires delivery by certified mail.

Then, a return postcard requiring attachment to the envelope, must be completed by the postal employee and/or the customer mailing the envelope containing the article. Some postcards include areas having an adhesive for attachment of the postcard to the envelope. Other postcards require separate attachment, such as using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee. Further, the postal employee must ensure that all articles are appropriately affixed to the envelope.

In addition, the return postcard must be suitably affixed such that the return postcard is not removed during the mailing of the article to its destination. Of course, it should be understood that an envelope being prepared for special service mailing may be prepared by any individual, not just a postal employee.

A need, therefore, exists for an improved mailpiece requiring special services having an integral document section that can be pre-printed along with the mailpiece requiring special services and a system for forming the mailpiece requiring special services, such as certified mail, insured mail, registered mail, COD, return receipt for merchandise and the like.

SUMMARY OF THE INVENTION

The present invention provides a special service mailpiece and a method for forming the mailpiece requiring special services, such as for certified mail, insured mail, register mail, COD, return receipt for merchandise and the like. The mailpiece includes an integral document section requiring special mailing service, including a sheet foldable into sections along a fold line to form the integral document section and a removably attached section which, after the sheet is folded and sealed, forms a return postcard.

To this end, in an embodiment of the present invention, a system is provided for mailing an article requiring special services. The system comprises a mailpiece having an integral document section requiring special mailing service. The mailpiece comprises: a sheet foldable into sections along a fold line to form an integral document section and a removably attached section which, after the sheet is folded and sealed, forms a return postcard.

In an embodiment, the mailpiece has a perforated tear line extending a length of the sheet for removing the return postcard.

In an embodiment, the mailpiece has a perforated tear line formed in a portion of the sheet which provides access to the integral document section after tearing the sheet along the perforated tear line.

In an embodiment, the mailpiece has a sealing section constructed and arranged to aid in forming the return postcard and to enclose the integral document section thereby forming the mailpiece.

In an embodiment, the mailpiece has a first sealing section on the sheet having a first adhesive; and a second sealing section on the sheet having a second adhesive wherein the first adhesive and the second adhesive bond to each other when subjected to appropriate pressure thereby forming the return postcard and enclosing the integral document section.

In an embodiment, the mailpiece has at least one identifier related to the mailpiece requiring special services correlated to an identifier located on the return postcard.

In an embodiment, the mailpiece has at least one detachable form constructed and arranged to detach from the sheet.

In an embodiment, the mailpiece has a delivery notice/receipt form constructed and arranged to detach from the sheet.

In an embodiment, the mailpiece has a delivery notice/receipt form with at least one identifier related to the mailpiece requiring special services.

In another embodiment of the present invention, a method is provided for forming a mailpiece having an integral document section requiring special services. The method has the steps of: providing a sheet foldable into sections along a fold line forming the mailpiece wherein at least one section includes an integral document section requiring special services; integrally forming a detachable return postcard with the mailpiece; integrally forming a detachable form with the mailpiece; and folding the sheet along the fold line to enclose the integral document section and to form the mailpiece.

In an embodiment, the method further comprises the step of providing a perforated tear line to assist in removing the return postcard and the detachable form from the mailpiece.

In an embodiment, the method further comprises the step of providing a perforated tear line constructed and arranged on the mailpiece to provide access to the integral document section after tearing the mailpiece along the perforated tear line.

In an embodiment, the method further comprises the steps of providing a second integral document section on a section of the sheet; and providing a second perforated tear line constructed and arranged on the mailpiece to provide access to the second integral document section after tearing the mailpiece along the second perforated tear line.

In an embodiment, the method further comprises the step of providing a designator on the mailpiece indicative of the special services required.

In an embodiment, the method further comprises the step of providing an instruction section to assist in forming the mailpiece.

In an embodiment, the method further comprises the step of arranging the sections on the sheet of the mailpiece such that all variable printing can be done on one side of the sheet.

In another embodiment of the present invention, a mailpiece having at least one integral document section requiring special mailing service is provided. The mailpiece comprises a sheet foldable into three sections along a first and a second fold line to form at least one integral document section and a removably attached section which, after the sheet is folded and sealed, forms a return postcard and a detachable form.

In an embodiment, the mailpiece further has a perforated tear line constructed and arranged to provide access to the at least one integral document section after tearing the mailpiece along the perforated tear line.

In an embodiment, the mailpiece further has a second integral document section on the sheet; and a second perforated tear line constructed and arranged to provide access to the second integral document section after tearing the mailpiece along the second perforated tear line.

It is, therefore, an advantage of the present invention to provide an improved system for mailing an article requiring special service.

Another advantage of the present invention is to provide a simplified method for forming a mailpiece requiring special services.

And, another advantage of the present invention is to provide a system and an assembly that is integrally formed as a complete unit for mailing and labeling of an article requiring special services.

Yet another advantage of the present invention is to provide a system for mailing an article and a method for forming a mailpiece requiring special services without requiring additional adhesives or fixatives for attaching the same to the mailpiece.

Moreover, an advantage of the present invention is to provide a system for mailing an article requiring special services and a method for forming a mailpiece requiring special services that is substantially foolproof.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a special service mailpiece having an integral document section requiring special services. Further, the present invention provides a method for forming a mailpiece requiring special services.

Figure 1:
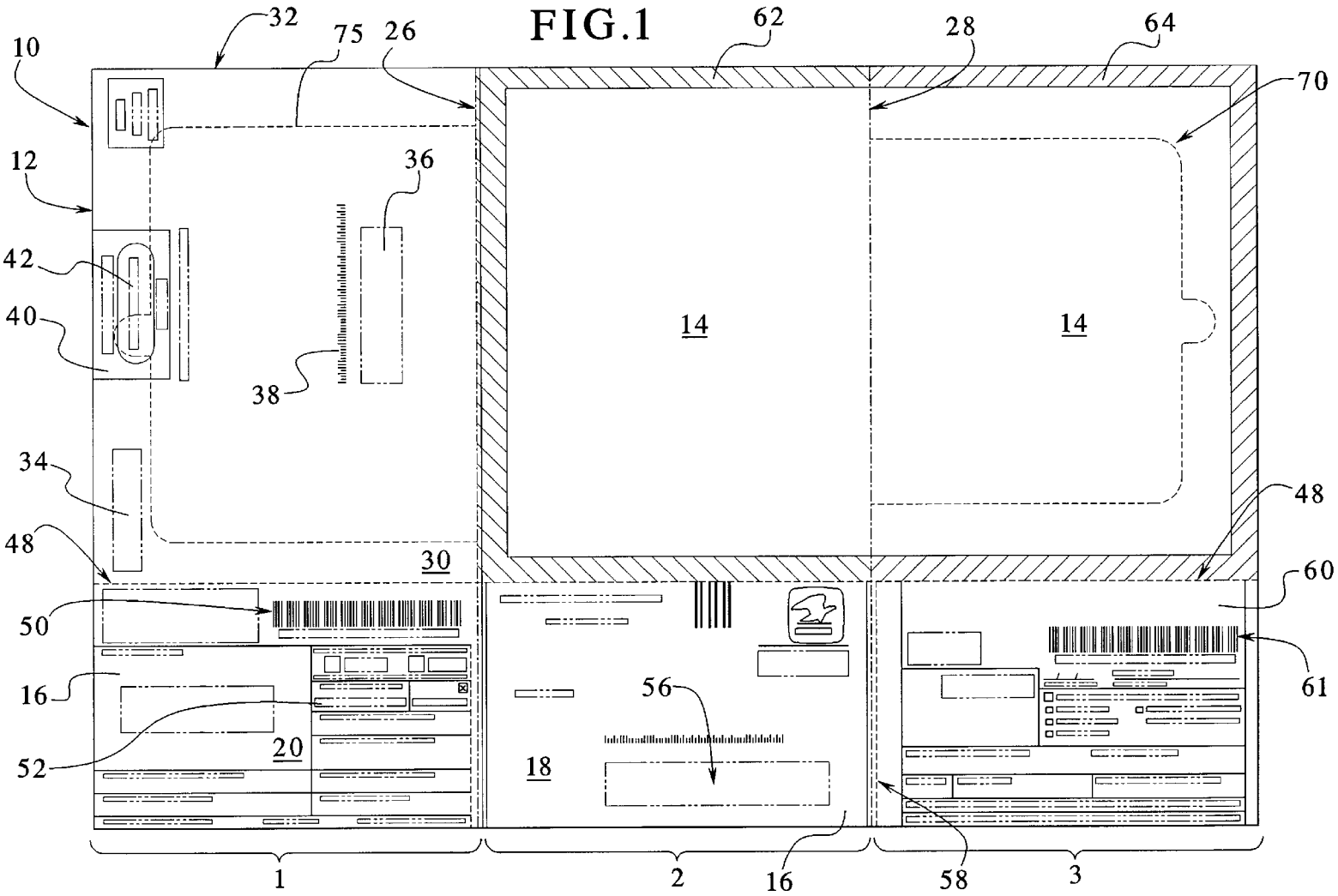
FIG. 1 illustrates a plan view of a front side of an embodiment of an assembly of the present invention.

Referring now to the drawings, wherein like numerals refer to like parts, FIG. 1 generally illustrates an assembly 10 formed from a single sheet 12 folded in a manner to provide: a personalized document portion 14 and a two-ply return postcard 16 having a front side 18 and a back side 20 used for the mailing of the personalized document portion 14 requiring a special mailing service. In addition, a delivery notice/reminder/receipt 24 is provided. Although a certified mail envelope is illustrated, it should be understood that the present invention is applicable to any mailing item requiring special services, such as insured mail, registered mail, COD, return receipt for merchandise and the like.

The assembly 10 illustrated in FIG. 1 on its front side comprises three primary sections, 1, 2 and 3. Section 1 of the assembly 10 is located adjacent to section 2 and has a fold line 26 therebetween as a demarcation line between the two sections 1, 2. Similarly illustrated in FIG. 1, section 2 is adjacent to section 3 and has a fold line 28 forming a common border between the two sections 2, 3. A description of the three sections 1, 2 and 3 follows.

Section 1 of the front side of the assembly 10 comprises a front side 30 of an envelope 32. Although referred to as "an envelope", the envelope 32 merely encloses a message in a document section (to be described hereinafter) of the sheet 12 and is not a true envelope in which something, such as a letter, can be inserted therein. The envelope 32 has a sender's address section 34 and an addressee address section 36. The addressee address section 36 also has a computer bar code 38 to aid in processing.

The envelope 32 of the assembly 10 includes, in a preferred embodiment, a pre-printed label 40 indicative of the special service required for mailing of the assembly 10. The label 40 is preferably pre-printed directly on the envelope 32 of the assembly 10.

Figure 3:
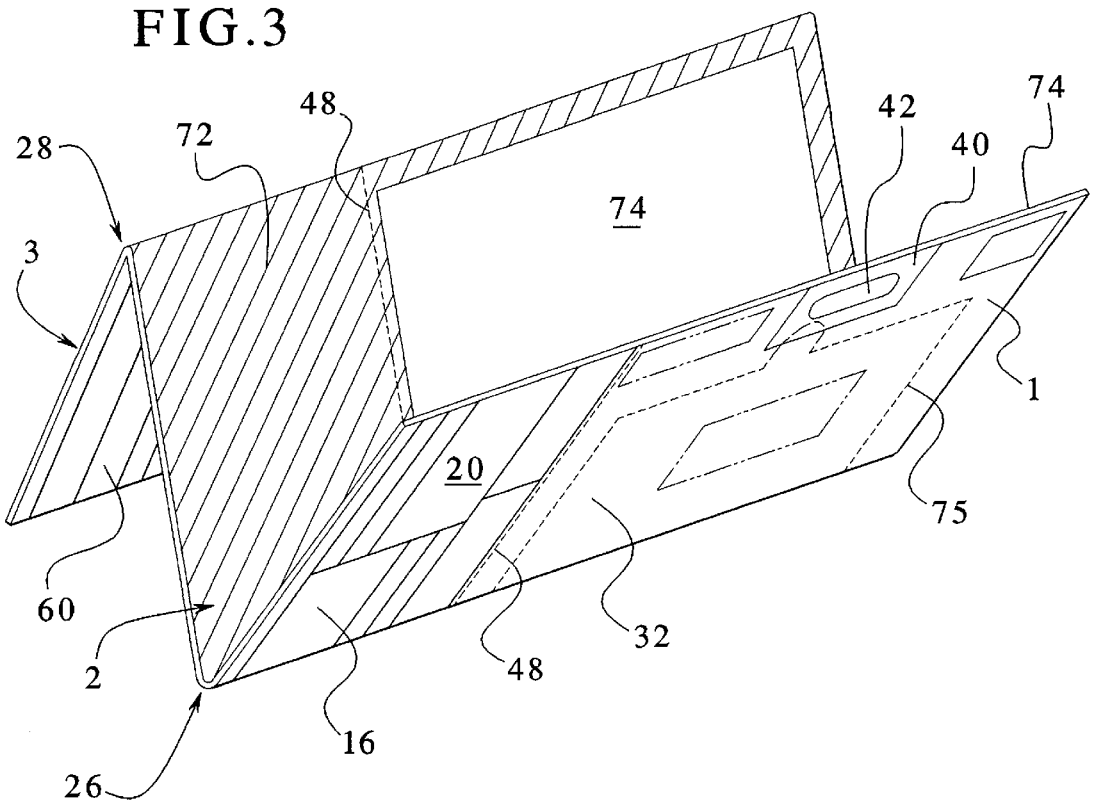
FIG. 3 illustrates a perspective view of an embodiment of a partially folded assembly of the present invention.
Figure 4:
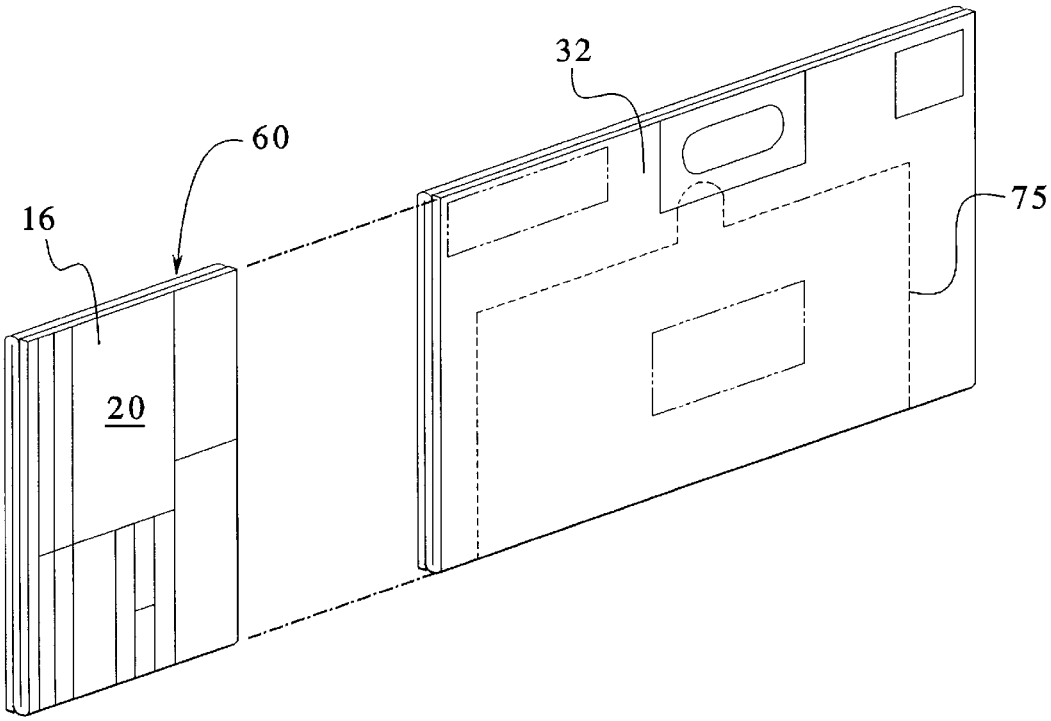
FIG. 4 illustrates a perspective view of the front side of an embodiment of the assembly of the present invention with a portion thereof detached.

The pre-printed label 40 includes a window section 42 including an article identification number. The window section 42 has an appearance of a window in that the window section 42 is distinct from the label 40. Therefore, an identifier that is printed in the window section 42 is clearly visible therein. The pre-printed label 40 is constructed and arranged such that the type of special service required for mailing of the assembly 10 is visible from both the front side 30 of the envelope 32 and a back side 44 of the envelope 32 as more clearly illustrated in FIG. 2. That is, the box with the designation "CERTIFIED MAIL" in FIG. 2 meets with the label 40 of FIG. 1 to appear as a continuous label after the sheet 12 is folded. Thus, the "CERTIFIED MAIL" designation is seen from both the front side 18 and the back side 20 of the assembly 10. However, the designation is printed on both sides of the sheet 12. Only after folding the sheet 12 as illustrated in FIGS. 3 and 4 will the label 40 appear continuously printed with the designation.

Section 1 also comprises the back side 20 of the return receipt postcard 16. The return receipt postcard 16 is removably attached to the assembly 10 and can be detached by tearing the return receipt postcard 16 away from the assembly 10 along a perforation tear line 48. The perforation tear line 48 runs the length of the assembly 10.

As mentioned above, section 1 of the assembly 10 includes the back side 18 of the return postcard 16. The return postcard 16 has a number of sub-sections requiring completion by the sender prior to mailing the assembly 10 to the addressee in the addressee address section 36 of the envelope 32. One sub-section illustrated at numeral 50 includes a machine readable article identification number corresponding to the number in the window section 42 of the pre-printed label 40. The sub-section 50 may have a contrasting background color to the remainder of the return postcard 16 so as to simplify the reading of the machine-readable code in sub-section 50. Other sections, as well, may include similar color-contrasting portions within the return postcard 16. The backside 20 of the return receipt postcard 16 may also include a sub-section 52 including machine-readable indicia with the article identification number corresponding to the number in the sub-section 50 and to the number in the window section 42 of the pre-printed label 40.

Now referring to Section 2 of the front side of the assembly 10, the return postcard 16 of the assembly 10 includes on its front side 18, a "Return To" section 56. The "Return To" section 56 may be color-contrasted with the remainder of the return postcard to enable simplified reading of the "Return To" section 56. A perforated tear line 58 is provided along the right exterior side of the return postcard 16 within Section 3 of the assembly 10. After tearing along the perforated tear line 58, a postal employee can tear along the perforated tear line 48 to detach the return postcard 16 from the assembly 10.

With reference now to Section 3 of the assembly, as illustrated in FIG. 1, in a preferred embodiment, a combined delivery notice/reminder/receipt form 60 is provided. This delivery notice/reminder/receipt form 60 is preferably U.S. Postal Service Form PS 3849. A bar code 61 bearing the article number is provided on the delivery notice/reminder/receipt 60.

Referring to both sections 2 and 3 in conjunction, the personalized document portion 14 is shown having a midpoint at fold line 28. In addition, in section 2 around the periphery of the personalized document portion 14 is a "first" adhesive strip 62. A similar "second" adhesive strip 64 is provided around the periphery of the personalized document section 14 in section 3. The fold line 28 provides the border between the first adhesive strip 62 and the second adhesive strip 64. When the assembly 10 is folded, and proper postage is applied, the first and second adhesive strips 62, 64 will provide an adequate adhesion level so that the document can be securely folded.

Figure 2:
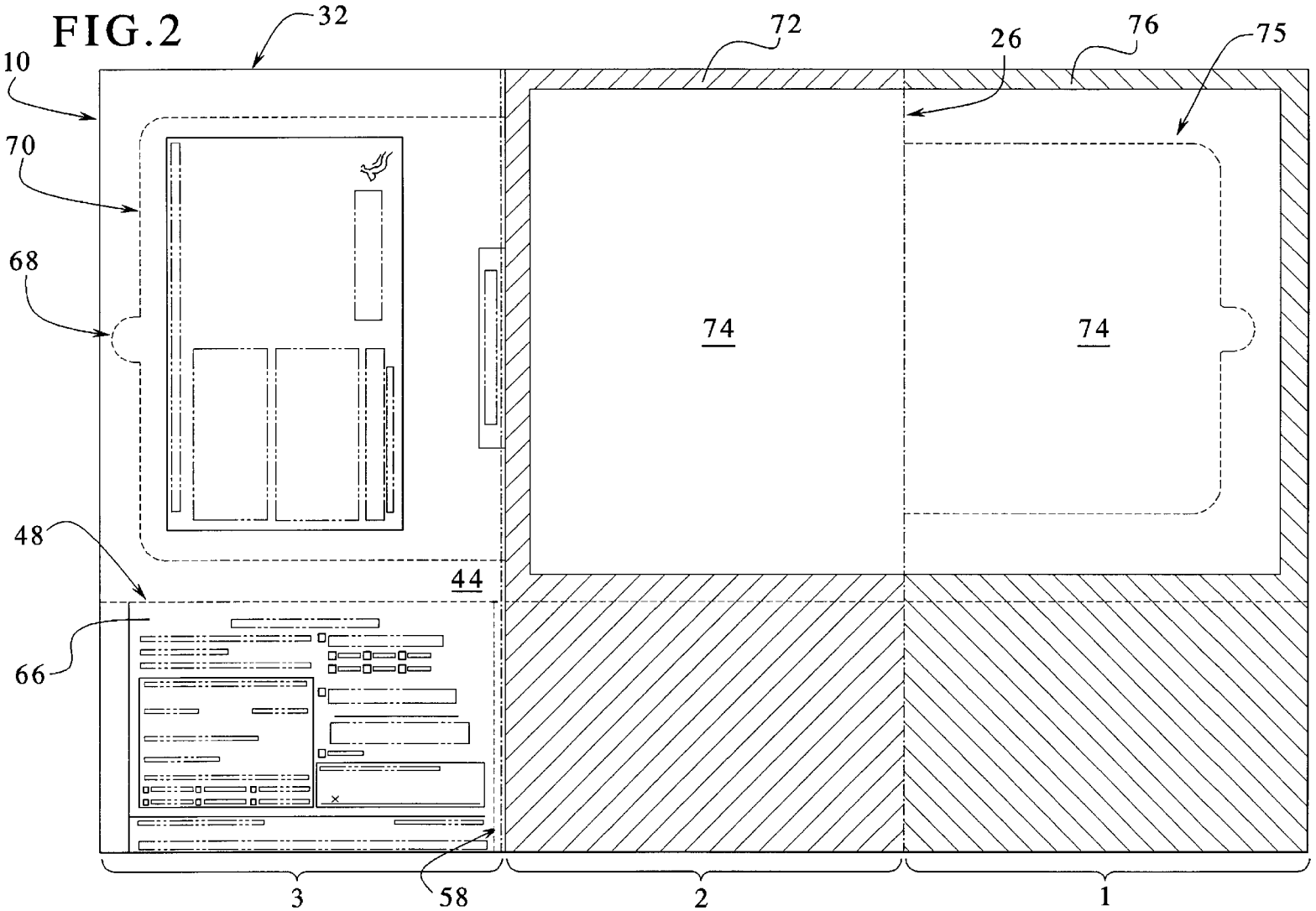
FIG. 2 illustrates a plan view of a back side of an embodiment of the assembly of the present invention.

Referring now to FIG. 2, a back side of the assembly 10 is illustrated. The back side 44 of the envelope 32 shown in FIG. 1 is, therefore, illustrated. Section 3 of the back side of the assembly 10 includes a back side 66 of the delivery notice/reminder/receipt 60 and the back side 44 of the envelope 32 separated by the perforated tear line 48.

In an embodiment, the back side 44 of the envelope 32 includes a die cut thumb groove 68 that operates in cooperation with a perforated tear line 70 to allow access to the interior of the envelope 32 for reading the personalized document portion 14.

Referring now to the back side 20 of the assembly 10, a second document section 74 is provided. A perforated tear line 75 (see FIG. 1), similar to the perforated tear line 70, is provided to allow access to the second document section 74. When the document sections 14 and 74 are used, access to messages printed on the document sections 14 and 74 may be obtained by separating at the perforated tear lines 70 and/or 75 and folding back the sections to view the document sections 14 and/or 74 and their respective printed messages.

It should be understood that the second document section 74 is an option. The present invention may, have either one of the document sections 14, 74 or both of them. However, the printing of the assembly is simplified when the document section 14 is used, since this document section 14 is on the front side of the assembly 10 as is all of the other variable printing.

Also on section 2, a first adhesive section 72 is provided about the periphery of a second personalized document section 74. Similarly, section 1 of the assembly 10 has a second adhesive section 76 located about the periphery of the second personalized document section 74. In addition, the first adhesive section 72 is continued on the lower portion of the back side of the assembly 10 and the female portion of the adhesive section 76 is continued at the bottom portion of section 1 so that adhesive sections 72 and 76 combine to form an enclosed surface and a return postcard 16. For example, the large portions of the first adhesive section 72 and the second adhesive section 76 are in contact thereby bonding the front side 18 and the back side 20 of the return postcard 16 to form the return postcard 16.

Referring to FIGS. 3–6, the front side of a partially folded assembly 10 is illustrated in FIG. 3, in which like numbers represent like parts. The assembly 10 is also shown in an unsealed condition. As illustrated in FIG. 3, certain elements of the assembly 10 are shown in relation to each other as they will be connected upon completion of the assembly 10. For example, the back side 20 of the return postcard 16 is illustrated folded along fold line 26 so that it comes into contact with the first adhesive section 72 that is applied to the back of the front side 18 of the return postcard 16 so that when connected they form an integral postcard 16. The pre-printed label 40 is shown having a window section 42 in which a certified mail number may be printed either manually or automatically.

FIG. 4 illustrates a front view of the assembly having the return postcard 16 and the delivery notice/reminder/receipt 60 illustrated as having been detached from the perforated tear line 48. Although both the return receipt 16 and the delivery notice receipt 60 are shown detached together from the envelope 32, the present invention provides that the delivery notice/reminder/receipt 60 can be separately detached from, and independent of, the return postcard 16. In this manner, the delivery notice/reminder/receipt 60 may be left with the addressee in the event of an unsuccessful delivery attempt.

Figure 5:
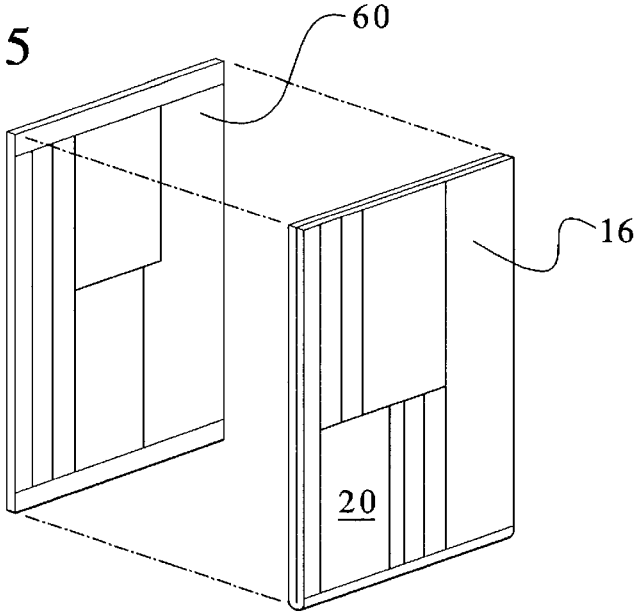
FIG. 5 illustrates a perspective view of the front side of an embodiment of a detached portion of the assembly of the present invention.

FIG. 5 illustrates the separated return postcard 16 and the delivery notice/reminder/receipt 60, having been removed from the envelope section 32 of the assembly 10 by the postal employee tearing the assembly at the perforated tear line 48.

Figure 6:
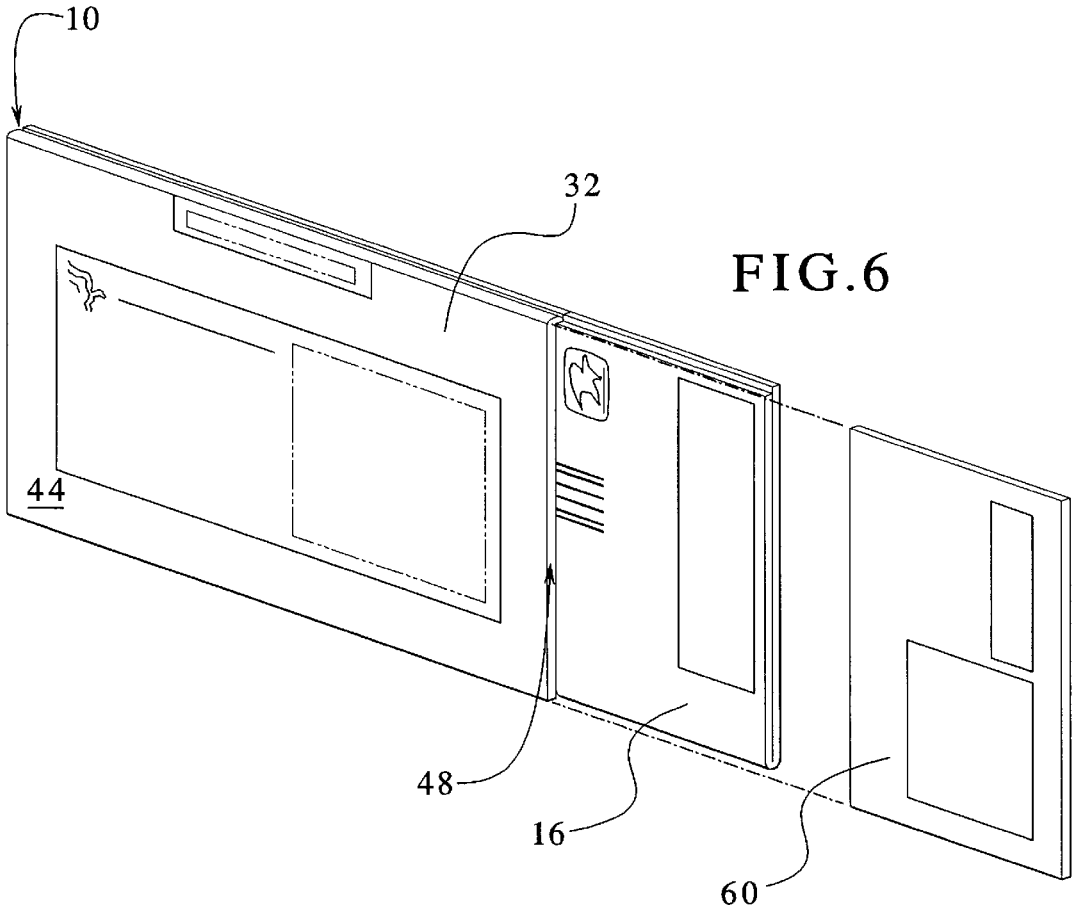
FIG. 6 illustrates a perspective view of the back side of an embodiment of the assembly of the present invention with a portion thereof detached.

FIG. 6 illustrates the back side 44 of the envelope 32 wherein the delivery notice/reminder/receipt 60 has been removed from the envelope 32 of the assembly 10. This is accomplished by the postal employee after an attempt to deliver the mailpiece by tearing the delivery notice/reminder/receipt 60 from the assembly 10 along the perforated tear line 48. The postal employee can then leave the delivery notice/reminder/receipt 60 at the addressee's address while the return postcard 16 remains attached to the assembly 10 until the actual delivery is completed.

Figure 7:
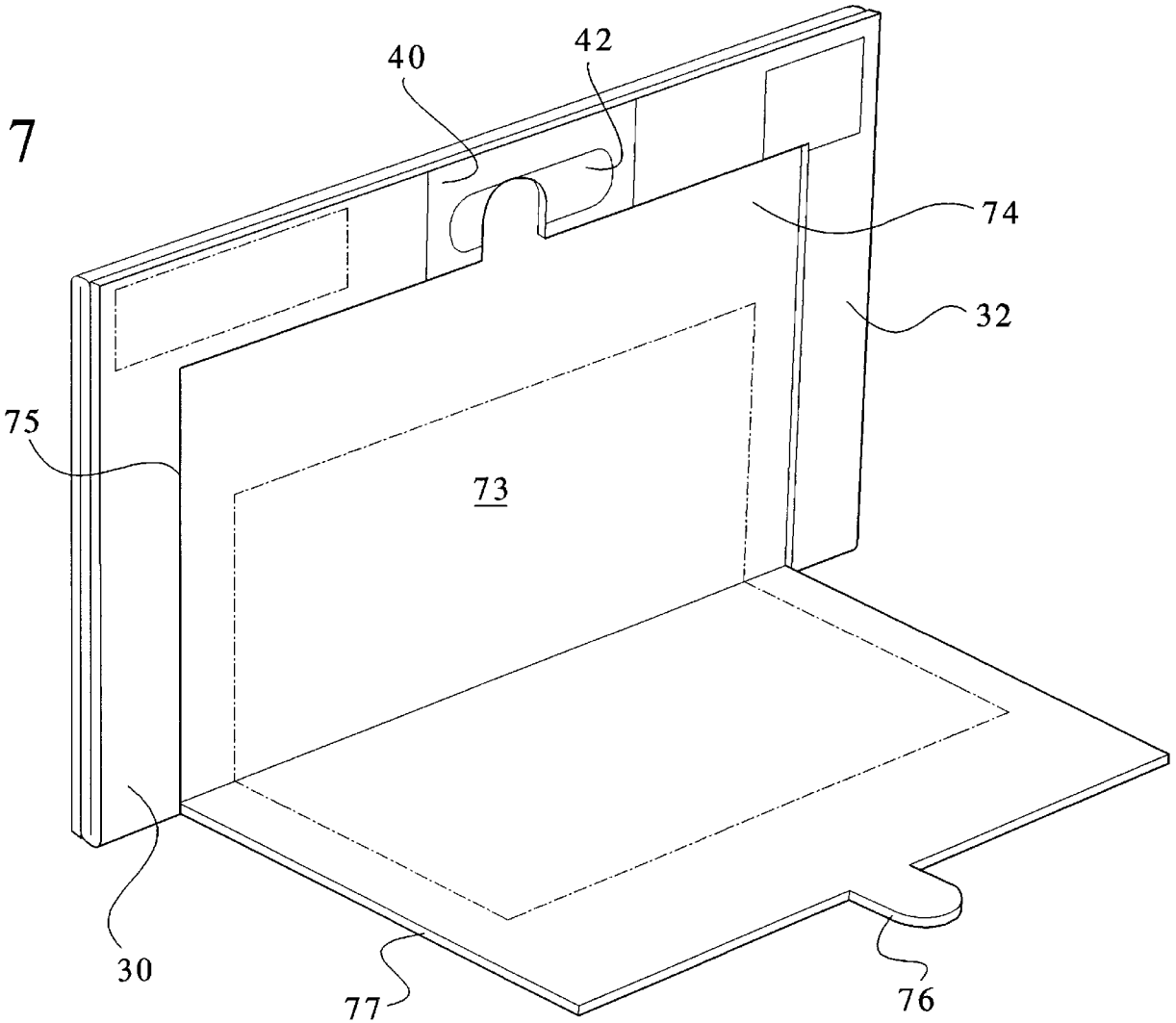
FIG. 7 illustrates a perspective view of the front side of the assembly with a portion of the front side removed for revealing of a message printed therein.

Referring now to FIG. 7, the front side 30 of the assembly is shown with the return postcard 16 (see FIG. 4) removed therefrom. The perforated tear line 75 provides access to a message 73 that may be printed in the second document section 74 accessible by pulling a tab 76 to assist in separating a flap 77 from the front side 30 of the envelope 32. As result, a simplified manner is provided for revealing the message 73 printed in the second document section 74.

Likewise, similar access may be provided to the first document section 14 by detaching a portion of the back side 44 of the envelope 32 along the perforated tear line 70 as illustrated in FIG. 2. As a result, a message printed on the document portion 14 may be revealed without affecting the remainder of the envelope 32.

The present invention provides the advantage that the sections on the sheet of the mailpiece are arranged such that all of the variable printing can be done on one side of the sheet. This is an especially convenient feature when automated printers are used in the processing of the mailpiece. If no message is required in the document section 74, all printing can be done on the side of the sheet shown in FIG. 1 by including the entire message in the document section 14. As shown in FIG. 1, the areas of variable printing to be done, (i.e. printing in areas 14, 34, 36, 42, 52 and 56) are all located on the same side of the sheet 12.

As an added advantage of the present invention, the delivery notice/reminder/receipt 60 located on the assembly 10 is of course removable and, thus, can also serve as a postal receipt. That is, the section includes the corresponding bar-coded article number 61 and a signature and date line wherein the receiver may sign on the line and date the same. Then, the postal employee or other designated sender may retain the sub-section within its records indicating the article number and the date on which the assembly 10 was received as attested to by the signature of the receiver.

In addition, the embodiment of the present invention shown in the FIGS. 1–6 shows the return postcard 16 and the delivery notice/reminder/receipt 60 perpendicularly oriented to the envelope 32. Of course other orientations of the elements of the mailpiece are possible. Such other orientations are intended to be covered by the claims herein.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A mailpiece having an integral document section requiring delivery by a special mailing service, the mailpiece comprising:

a sheet having a length defined between a first end and a second end having a front side and a back side wherein each side defines a plurality of sections contiguously connected between the first end and the second end wherein at least one of the plurality of sections includes an integral document section on the front side of the sheet and another one of the plurality of sections includes at least a portion of a return postcard and further wherein the sheet has an identifier indicative of the special mailing service wherein the portion of the return postcard is adjacent the integral document section in one of the plurality of sections;

fold lines between adjacent ones of the plurality of sections defining each of the plurality of sections;

adhesive areas on the back side of the sheet having an adhesive for securing adjacent sections of the plurality of sections after folding at the fold lines between adjacent ones of the plurality of sections;

a first sealing section on the front side of the sheet in one of the plurality of sections having a first adhesive; and a second sealing section on the front side of the sheet in an adjacent one of the plurality of sections having a second adhesive wherein the first adhesive and the second adhesive bond to each other when subjected to pressure thereby closing the integral document section.

2. The mailpiece of claim 1 further comprising:

a perforated tear line extending a length of the sheet.

3. The mailpiece of claim 1 further comprising:

a perforated tear line formed in the back side of the sheet in one of the plurality of sections capable of providing access to the integral document section.

4. A mailpiece having at least one integral document section requiring delivery by a special mailing service, the mailpiece comprising:

a sheet having a length defined between a first end and a second end and further having a front side and a back side including three sections contiguously connected between the first end and the second end wherein one of the sections includes an identifier indicative of the special mailing service;

a first fold line and a second fold line defining the three sections on the front side and the back side of the sheet;

an integral document section formed in one of the sections on the front side of the sheet;

an adhesive area in each of two adjacent sections on the back side of the sheet; and at least a portion of a return postcard laterally displaced within another one of the sections on the front side of the sheet wherein the return postcard is detachable from the sheet.

5. The mailpiece of claim 4 further comprising:

a perforated tear line constructed and arranged on the sheet to provide selective access to the at least one integral document section on the front side of the sheet.

6. The mailpiece of claim 4 further comprising:

a second integral document section on the back side of the sheet; and a second perforated tear line constructed and arranged on the sheet to provide access to the second integral document section.

7. A mailpiece having an integral document section requiring delivery by a special mailing service, the mailpiece comprising:

a sheet having a length defined between a first end and a second end having a front side and a back side wherein each side defines a plurality of sections contiguously connected between the first end and the second end wherein at least one of the plurality of sections includes an integral document section on the front side of the sheet and another one of the plurality of sections includes at least a portion of a return postcard and further wherein the sheet includes an identifier indicative of the special mailing service wherein the portion of the return postcard is adjacent the integral document section in one of the plurality of sections;

fold lines between adjacent ones of the plurality of sections defining each of the plurality of sections vertically displaced from one another between the first end and the second end;

adhesive areas on the back side of the sheet having an adhesive for securing adjacent sections of the plurality of sections after folding at the fold lines between adjacent ones of the plurality of sections; and an identifier in one of the plurality of sections wherein the same identifier is provided on the return postcard.

8. A mailpiece having an integral document section requiring delivery by a special mailing service, the mailpiece comprising:

a sheet having a length defined between a first end and a second end having a front side and a back side wherein each side defines a plurality of sections wherein at least one of the plurality of sections includes an integral document section on the front side of the sheet and another one of the plurality of sections includes at least a portion of a return postcard and further wherein the sheet includes an identifier indicative of the special mailing service wherein the portion of the return postcard is adjacent the integral document section in one of the plurality of sections;

fold lines between adjacent ones of the plurality of sections defining each of the plurality of sections;

adhesive areas on the back side of the sheet having an adhesive for securing adjacent sections of the plurality of sections after folding at the fold lines between adjacent ones of the plurality of sections; and a detachable form constructed and arranged in one of the plurality of sections of the sheet.

9. The mailpiece of claim 8 further comprising:

an identifier on the detachable form wherein the identifier is the same identifier as the identifier on one of the plurality of sections and the postcard.

* * * * *